US007774999B2

(12) United States Patent
McKee

(10) Patent No.: US 7,774,999 B2
(45) Date of Patent: Aug. 17, 2010

(54) ROOF VENT

(75) Inventor: James H. A. McKee, Midhurst (CA)

(73) Assignee: Canplas Industries Ltd., Barrie, Ontario (CA)

( * ) Notice: Subject to any disclaimer, the term of this patent is extended or adjusted under 35 U.S.C. 154(b) by 124 days.

(21) Appl. No.: 11/705,619

(22) Filed: Feb. 13, 2007

(65) Prior Publication Data

US 2007/0204532 A1 Sep. 6, 2007

(30) Foreign Application Priority Data

Feb. 13, 2006 (CA) ..... 2536023

(51) Int. Cl.
*F24F 7/02* (2006.01)
*F24F 13/20* (2006.01)

(52) U.S. Cl. ..... 52/199; 454/368

(58) Field of Classification Search ..... 52/198, 52/199, 200, 72, 95, 218, 219; 454/366, 454/367, 368
See application file for complete search history.

(56) References Cited

U.S. PATENT DOCUMENTS

| | | | | | |
|---|---|---|---|---|---|
| 299,387 | A | | 5/1884 | Hayes | |
| 445,685 | A | | 2/1891 | Bickelhaupt | |
| 683,225 | A | * | 9/1901 | Rosen | 454/363 |
| D121,410 | S | | 7/1940 | Gunter | |
| 2,889,763 | A | * | 6/1959 | Pine | 454/185 |
| D189,559 | S | | 1/1961 | Breidert et al. | |
| 3,011,423 | A | | 12/1961 | Breidert | |
| 3,063,358 | A | * | 11/1962 | Breidert | 454/341 |
| 3,213,776 | A | | 10/1965 | Adams | |
| 3,238,862 | A | | 3/1966 | Smith et al. | |
| 4,189,989 | A | * | 2/1980 | Maze | 454/38 |
| 4,545,291 | A | | 10/1985 | Kutsch et al. | |
| 4,549,693 | A | | 10/1985 | Barlics | |
| 4,572,059 | A | * | 2/1986 | Ramsay | 454/367 |
| 4,598,505 | A | * | 7/1986 | McGown | 52/58 |
| 4,621,569 | A | * | 11/1986 | Fioratti | 454/364 |
| 4,848,653 | A | * | 7/1989 | Van Becelaere | 236/49.3 |
| 5,050,489 | A | * | 9/1991 | Mankowski | 454/365 |
| 5,081,914 | A | | 1/1992 | Mejia | |
| 5,394,663 | A | * | 3/1995 | Jackson | 52/199 |
| 5,561,952 | A | * | 10/1996 | Damron | 52/198 |
| 6,767,281 | B2 | | 7/2004 | McKee | |
| 6,805,627 | B2 | * | 10/2004 | Marts et al. | 454/368 |
| 6,926,600 | B1 | * | 8/2005 | Arnold, Jr. | 454/12 |
| 2001/0023173 | A1 | * | 9/2001 | Schiedegger et al. | 454/367 |

* cited by examiner

*Primary Examiner*—Brian E Glessner
(74) *Attorney, Agent, or Firm*—Hoffmann & Haron, LLP

(57) ABSTRACT

A roof vent is provide. The roof vent comprises a top component coupled to a bottom component. The top component has a top wall, a side wall, a first louvered region disposed between said top wall and said side wall, and a top cylindrical baffle located inwardly of said first louvered region. The bottom component has at least a first cylindrical collar sized and shaped for mounting to a cylindrical exhaust stack of a first diameter, a second louvered region, and a bottom cylindrical baffle located below and inwardly of the top cylindrical baffle. The first louvered and second louvered regions are for helping to prevent insects, and moisture, such as snow and rain, from entering the roof vent. The top component may also be used separately from the bottom component to cover over aging or aesthetically unpleasing passive pot vents.

29 Claims, 7 Drawing Sheets

ROOF VENT

CROSS-REFERENCE TO RELATED APPLICATION

This application claims the benefit of Canadian Application No. 2,536,023, filed Feb. 13, 2006, titled "Roof Vent", the contents of which are incorporated by reference herein.

FIELD OF THE INVENTION

This invention relates generally to building products and in particular to ventilation devices which are used in buildings to provide for the circulation of air between an exterior and an interior or closed in portion of the building. Most particularly this invention relates to vents that are used to permit ventilation of attics or other spaces under a roofed area and which are referred to as passive roof vents.

BACKGROUND OF THE INVENTION

As is well known, if a building is warm inside and cold outside, and there is sufficient humidity within the building, this humidity will condense on contact with the cold surface of the building. This is usually most noticeable at the roof. Such condensed humidity or moisture will eventually cause the wood and other roof material to rot. Thus preventative measures are typically necessary to prevent such condensation from occurring. One such measure is to adequately ventilate all parts of the building where condensation is likely to occur.

Apart from the condensation problem mentioned above, there also exists the basic ventilation problem of removing state air from enclosed spaces, and replacing it with fresh outside air. Roof mounted ventilation devices can also be used for this purpose.

Accordingly, there have been numerous examples proposed in the past of roof mounted structures to provide suitable ventilation for various ventilation purposes.

One such device is known as a Turbine Ventilator and is described in U.S. Pat. No. 3,267,833 to Artis et al. This invention provides a free flow roof turbine or ventilator, which have since become commonly utilized to inexpensively exhaust dormant hot air from attics or other space under a roofed area. They are also used to evacuate warm air from such areas as kitchens or laundries.

Turbine ventilators are generally constructed of a plurality of curvilinear blades supported in a freely rotatable frame. The blades are contoured and oriented in relation to one another such that warm air rising from below, passes through the blades and due to the blade orientation, urges the blades and consequently the frame to rotate and expel the warm air.

One of the disadvantages of the prior art turbine vent devices is that they require a minimum of two to four separate and distinct members or pieces which are relatively expensive to manufacture and which necessitate a relatively complicated process to construct together to form the desired vent apparatus. Moreover, such conventional turbine vent devices are not sturdy, have limited duration of use, are susceptible of deterioration when exposed to the elements, and require somewhat complicated interconnection procedures. Furthermore, the venting efficiency leaves room for improvement.

Another disadvantage of such turbine vent devices is that they do not provide adequate protection against insects and the weather (i.e. rain and snow) from entering through the device and into the vented area.

These problems with the turbine vent devices have been recognized and attempts have been made to address the various problems through the use of passive roof vents of various shapes, sizes, forms, and features.

However, all of these passive roof vents require the complete replacement of the turbine vent device including the exhaust shaft to which they are mounted, which adds to the expense of replacing these turbine vent devices.

Aside from the turbine roof vents, aging passive pot vents may have been installed begin to look unsightly or may be leaking, and may allow weather to pass through into the building enclosure.

Accordingly, what is desired is a cost effective way for replacing pre-existing turbine roof vent installations, while at the same time overcoming the problems with prior art roof vents. Furthermore, it is also desirable to overcome the problems associated with aging pot vents.

SUMMARY OF THE INVENTION

The present invention is a roof vent, formed from two components of moulded plastic which has cylindrical collars that are sized and shaped to fit existing twelve inch and fourteen inch diameter exhaust stacks of turbine, or other, roof vents.

According to a first aspect of the present invention the top and bottom components may be coupled together to form a roof vent for use as a cost effective replacement for existing turbine roof vents, while at the same time eliminating or greatly alleviating the problems, disadvantages and complexity common to conventional roof vents.

Therefore, there is disclosed a roof vent comprising:

a top component having a top wall, a side wall, a first louvered region disposed between said top wall and said side wall, and a top cylindrical baffle located inwardly of said first louvered region; and a bottom component coupled to said top component, said bottom component having at least a first cylindrical collar sized and shaped for mounting to a cylindrical exhaust stack of a first diameter, a second louvered region, a bottom cylindrical baffle sized and positioned relative to said top baffle to form a sinuous flow path for air passing through said vent;

wherein said first louvered region and said second louvered region and said baffles permit the free flow of air through said vent, but inhibit insects and moisture from passing though said vent.

According to a second aspect of the present invention the top component may be used separately, without the bottom component, as a shelter to cover over existing passive pot roof vents that may be leaking or aesthetically unappealing, and to further prevent weather from passing through the pot vent into the building enclosure.

Therefore, there is also disclosed a roof vent as above, wherein said top component may be used separately to cover over an existing passive pot vent.

BRIEF DESCRIPTION OF THE DRAWINGS

Reference will now be made, by way of example only, to drawings illustrating the preferred embodiments of the invention, in which.

DETAILED DESCRIPTION OF THE PREFERRED EMBODIMENTS

The present invention is described in more detail with reference to exemplary embodiments thereof as shown in the appended drawings. While the present invention is described below including preferred embodiments, it should be understood that the present invention is not limited thereto. Those of ordinary skill in the art having access to the teachings herein will recognize additional implementations, modifications, and embodiments which are within the scope of the present invention as disclosed and claimed herein. In the figures, like elements are given like reference numbers.

Figure 1:
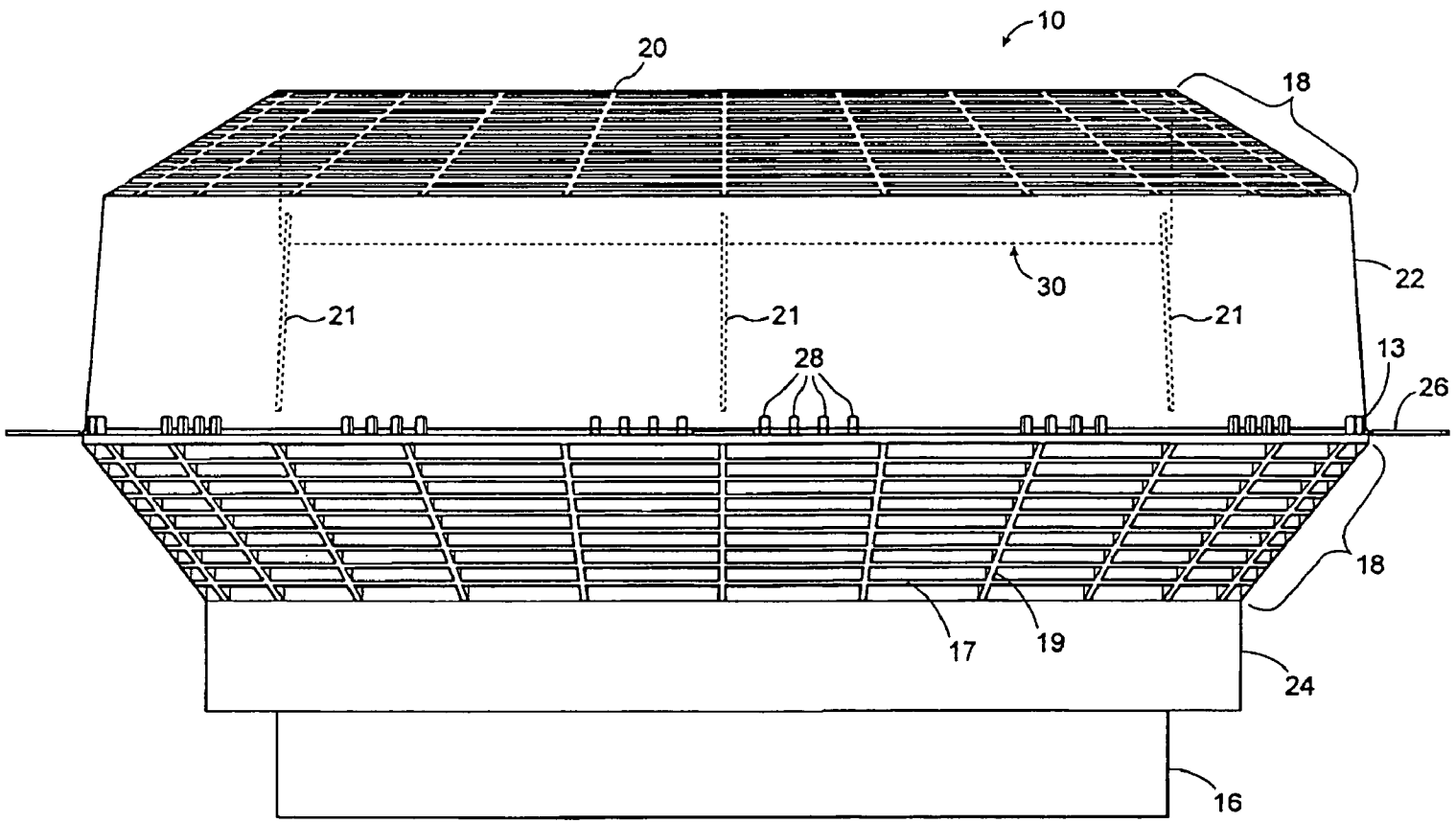
FIG. 1 is a side view of a roof vent of the present invention.
Figure 3:
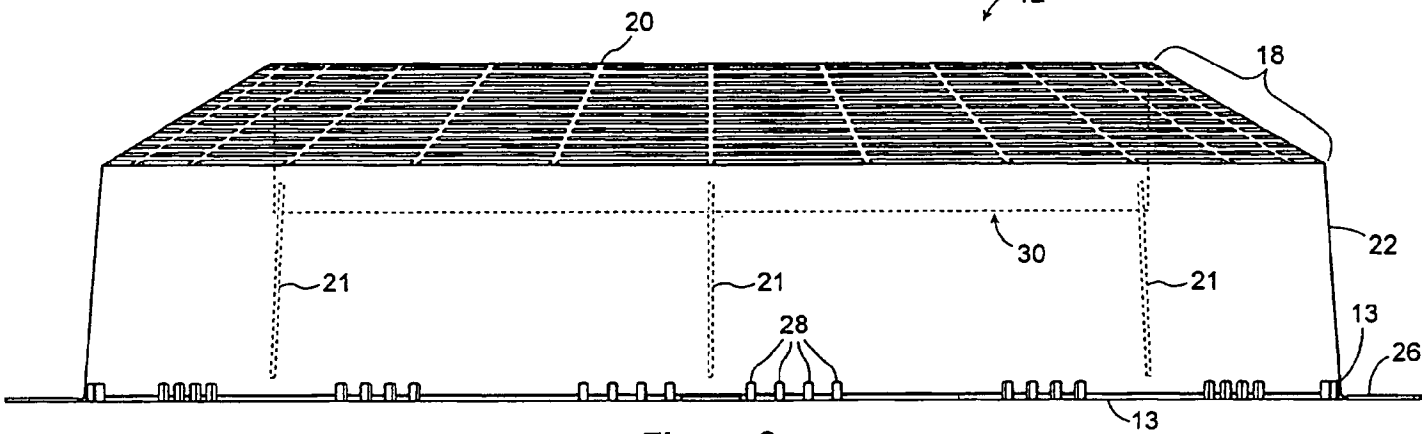
FIG. 3 is a side view of a top component of the present invention.
Figure 4:
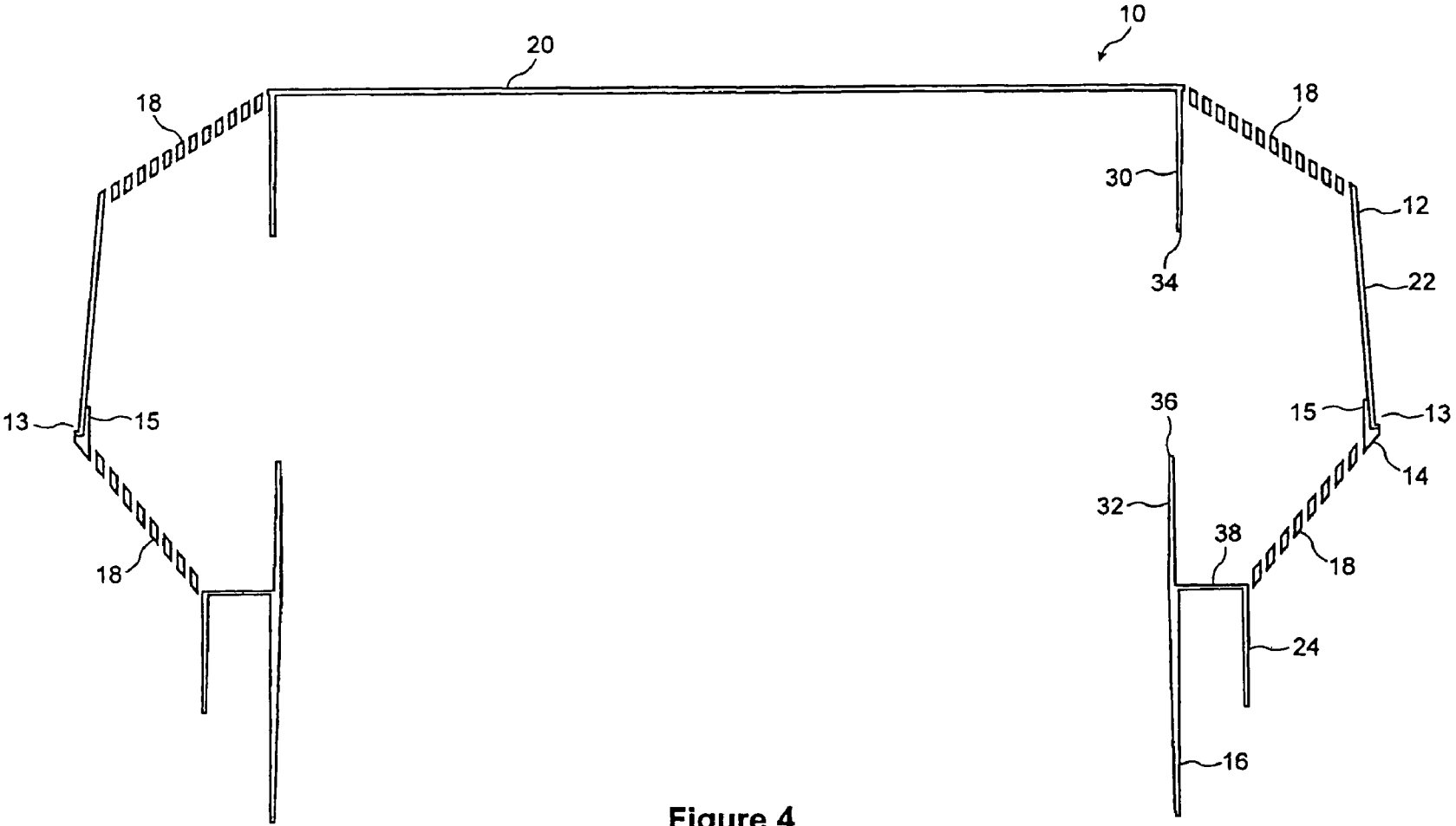
FIG. 4 is a cross-sectional view of the roof vent of FIG. 1.

A roof vent 10, according a first aspect of the present invention, is disclosed in FIG. 1. The roof vent 10 comprises a bottom component 14 (see FIG. 2), and a top component 12 (see FIG. 3). As shown in FIG. 4 the top component 12 and bottom component 14 are joined together along the perimeter via a friction fit coupling between a lower edge 13 a side wall 22 of the top component 12 and a complementary lip 15 on the bottom component 14. Both the top component 12 and the bottom component 14 may be formed from molded plastic as is well known in the art. A weather resistant form of plastic having appropriates UV blockers and an aesthetical pleasing colour is preferred.

Figure 2:
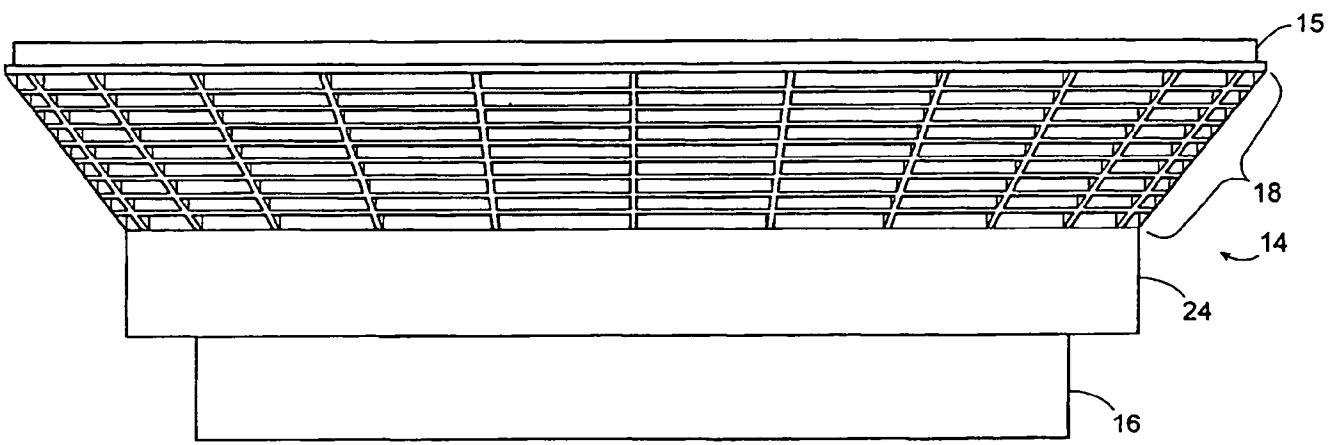
FIG. 2 is a side view of a bottom component of the present invention.

As shown in FIG. 2, the bottom component 14 includes a first cylindrical collar 16 which preferably has an interior diameter of about 12.1 inches. Most preferably the first cylindrical collar 16 has an internal diameter which gradually decreases from the opening to a narrower diameter at the other end. This taper has two benefits, namely that it makes it easier to mold and secondly it enables the vent to be friction fit onto the exhaust stack. While other anchoring means are also desirable, such as screws or glue or the like, a good friction fit is helpful to add to the stability and integrity of the installation. The bottom component 14 also includes a second cylindrical collar 24 which preferably has an interior diameter of about 14.13 inches. Most preferably the second cylindrical collar 24 has an internal diameter which gradually decreases or tapers from the opening to the other end, in a like manner to that disclosed above for the narrower diameter section. As will be appreciated by those skilled in the art, the first cylindrical collar 16 is preferably provided to fit over a nominal twelve inch diameter exhaust stack 25, while the second cylindrical collar 24 is provided to fit over a nominal fourteen inch diameter exhaust stack 25. Accordingly, the roof vent 10 of the present invention is capable of being mounted to more than one of the commonly used exhaust stack 25 diameters. While more collars could be provided if needed, two is believed sufficient to cover most applications, but two or more such collars are contemplated by the present invention also.

Figure 5:
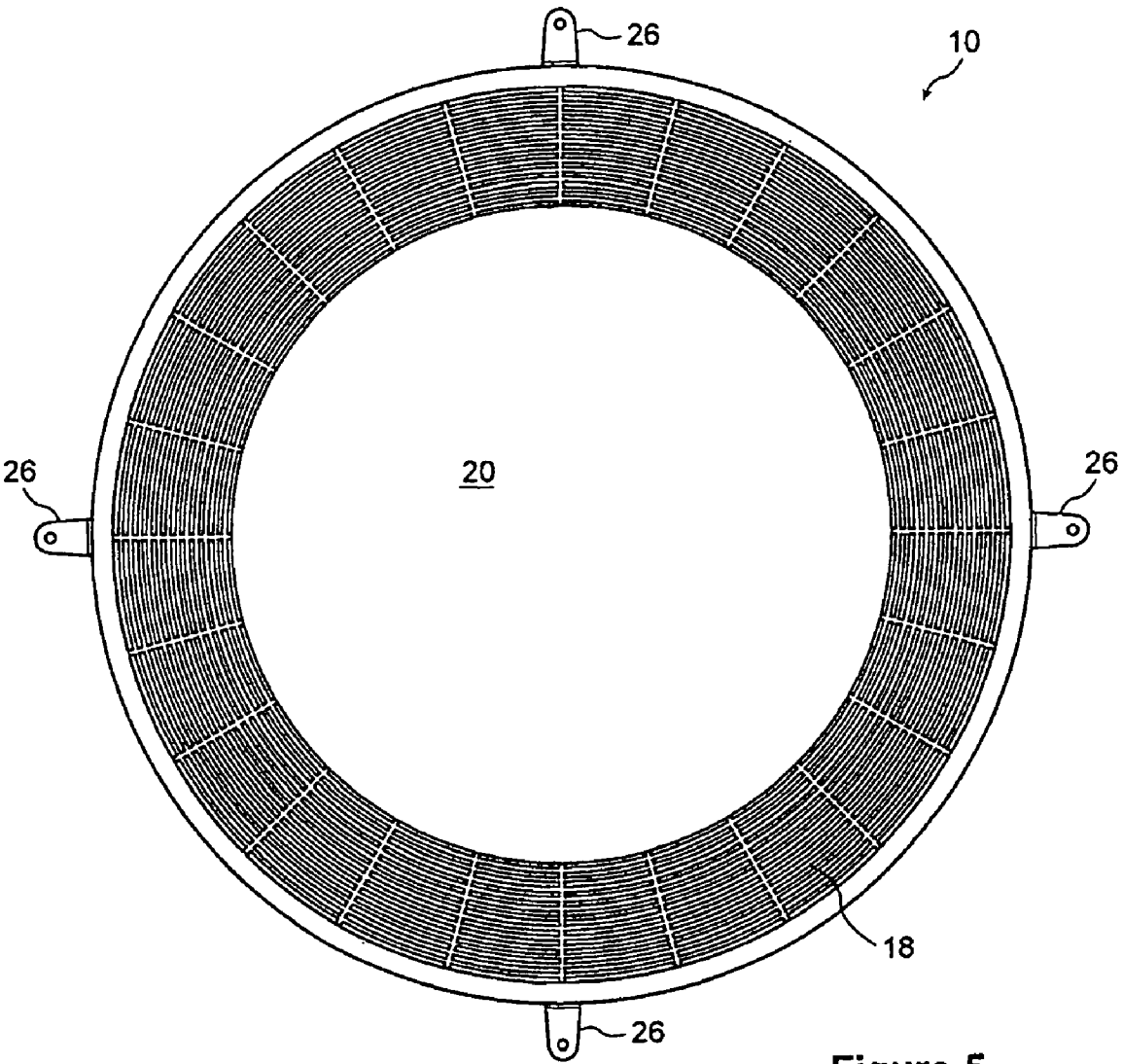
FIG. 5 is a top view of the roof vent of FIG. 1.

Referring back to FIG. 1, it can be seen that the roof vent 10 has louvered regions 18 on both the top component 12 and the bottom component 14. The individual louvers 17 are supported by ribs 19. The louvered regions 18 are for allowing exhaust air to leave the roof vent 10, and fresh air to enter, while helping to keep rain, snow, moisture and insects out. The louvered regions 18 circumscribe the roof vent 10, as is best seen in FIG. 5, which shows a top view of the roof vent 10. The louvered region 18 of the bottom component 14 expands outwardly from the exhaust stack 25, and the louvered region 18 of the top component 12 expands outwardly from the top 20 of the roof vent 10, to maximize the net free airflow area of the roof vent 10. The spaces between the louvers 17 are most preferably about 0.116 inches, but other spacing is also comprehended. What is important is that the louvered region 18 allows air to pass through into the exhaust stack 25, but helps to keep rain, snow, moisture, and insects out, as described in more detail below. The most preferred form of louver structure is a molded plastic structure for ease of manufacturing and cost, but other materials could also be used.

According to one aspect of the present invention the louvers are in the form of slats which extend in a downwardly direction. The size of each louver is designed to cause any driving precipitation to strike the louver and to so be directed downwardly as it passes through the louvers. Thus, there is less chance of precipitation being able to penetrate past the louvers and into the stack between the two baffles.

As shown in FIGS. 1 and 5, the top 20 and side 22 walls of the top component 12 are solid. Internal support members 21 may be added to reinforce the side walls 22.

Figure 6:
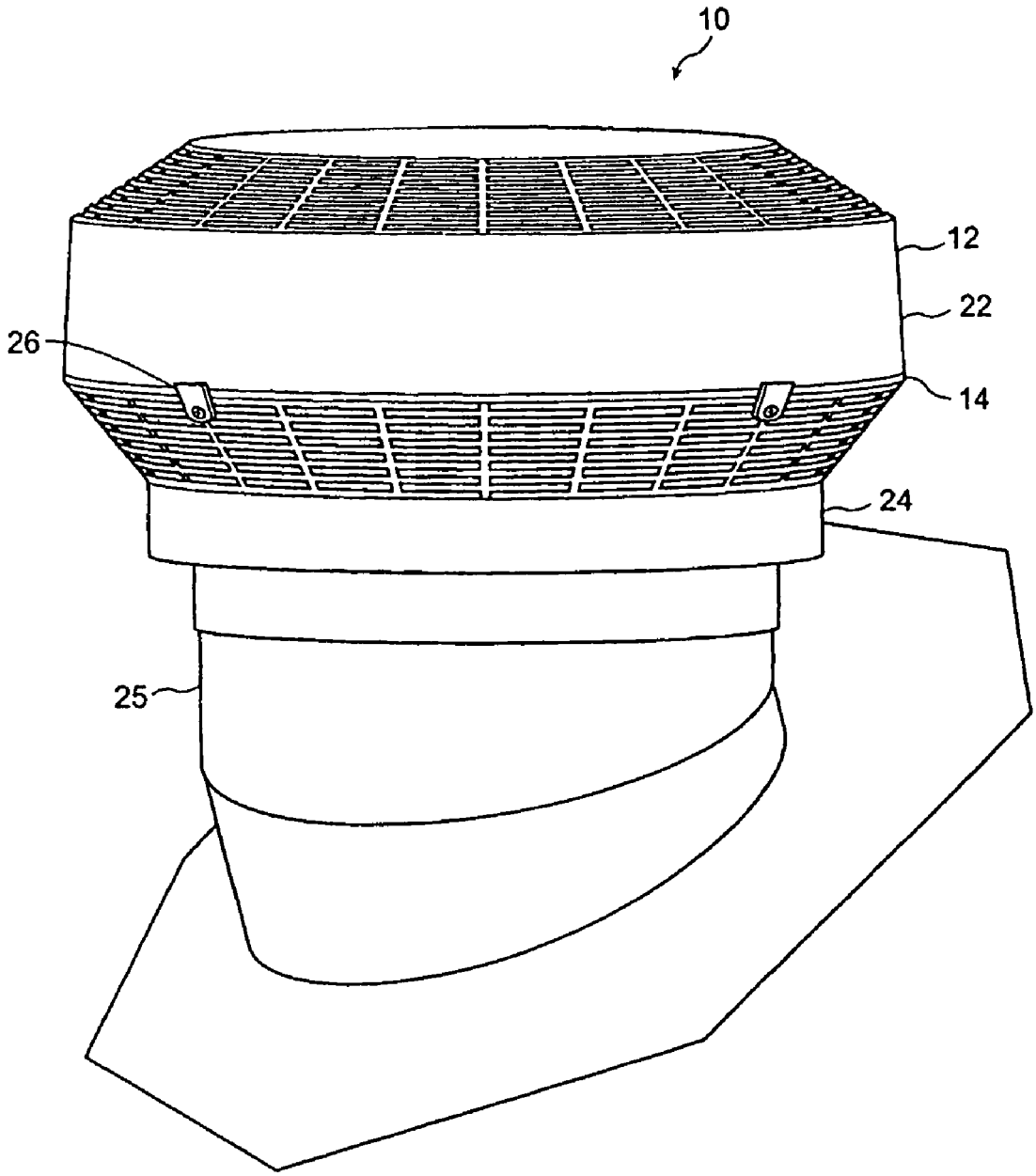
FIG. 6 is a perspective view of the roof vent of FIG. 1 mounted on an exhaust stack.
Figure 9:
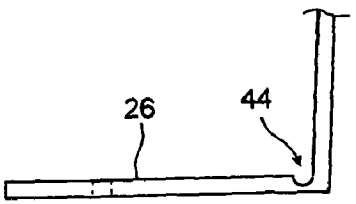
FIG. 9 is a side view of a tab connected to a lower edge of the top component of FIG. 3 by a living hinge.

Four tabs 26 extend from a lower edge 13 of the side walls 22 of the top component 12 via living hinges 44 (see FIG. 9). According to the first aspect of the present invention, the tabs 26 are for securing the connection between the top component 12 and the bottom component 14, once the top component 12 and bottom component 24 are connected via the friction fit coupling described above. To this end, the tabs 26 may be provided with a hole for allowing the shank of a threaded fastener to pass therethrough. In this way the tabs 26 may be bent towards the louvered region 18 of the bottom component 14, to lie flat along the surface thereof, and a threaded fastener may be used to secure the tab 26 to the bottom component 14. FIG. 6 shows a roof vent 10 mounted onto an exhaust stack 25, wherein tabs 26 are used to secure the top component 12 to the bottom component 14.

Internally, as seen in FIG. 4, the top component 12 and bottom component 14 together form a baffle system in the roof vent 10 for creating a sinuous or tortuous pathway to inhibit airborne precipitation, such as rain or snow that otherwise passes through the louvered regions 18 from entering into the exhaust stack 25 past the baffles. The baffle system consists of a top cylindrical baffle 30 formed inside of the top component 12, and a bottom cylindrical baffle 32 formed inside the bottom component 14. In the most preferred embodiment of the invention the top cylindrical baffle 30, and bottom cylindrical baffle 32 are spaced apart to allow exhaust air to leave the roof vent 10, and the top cylindrical baffle 30 has a slightly larger diameter than the bottom cylindrical baffle 32 so that its edge 34 hangs past the edge 36 of the bottom cylindrical baffle 32. In this embodiment any precipitation making it past the louvered regions 18 will be blocked by the baffles before entering the exhaust stack 25 and will collect in a drainage channel 38 which is provided in the bottom component 14 to direct any water that enters through the louvered regions 18 out along the outer surface of the second cylindrical collar 24.

FIG. 6 shows the roof vent 10, according to the first aspect of the present invention, as it would appear mounted on an exhaust stack 25, which is capable of being angled with respect to its base by rotating the top portion of the stack about an angled joint.

Figure 7:
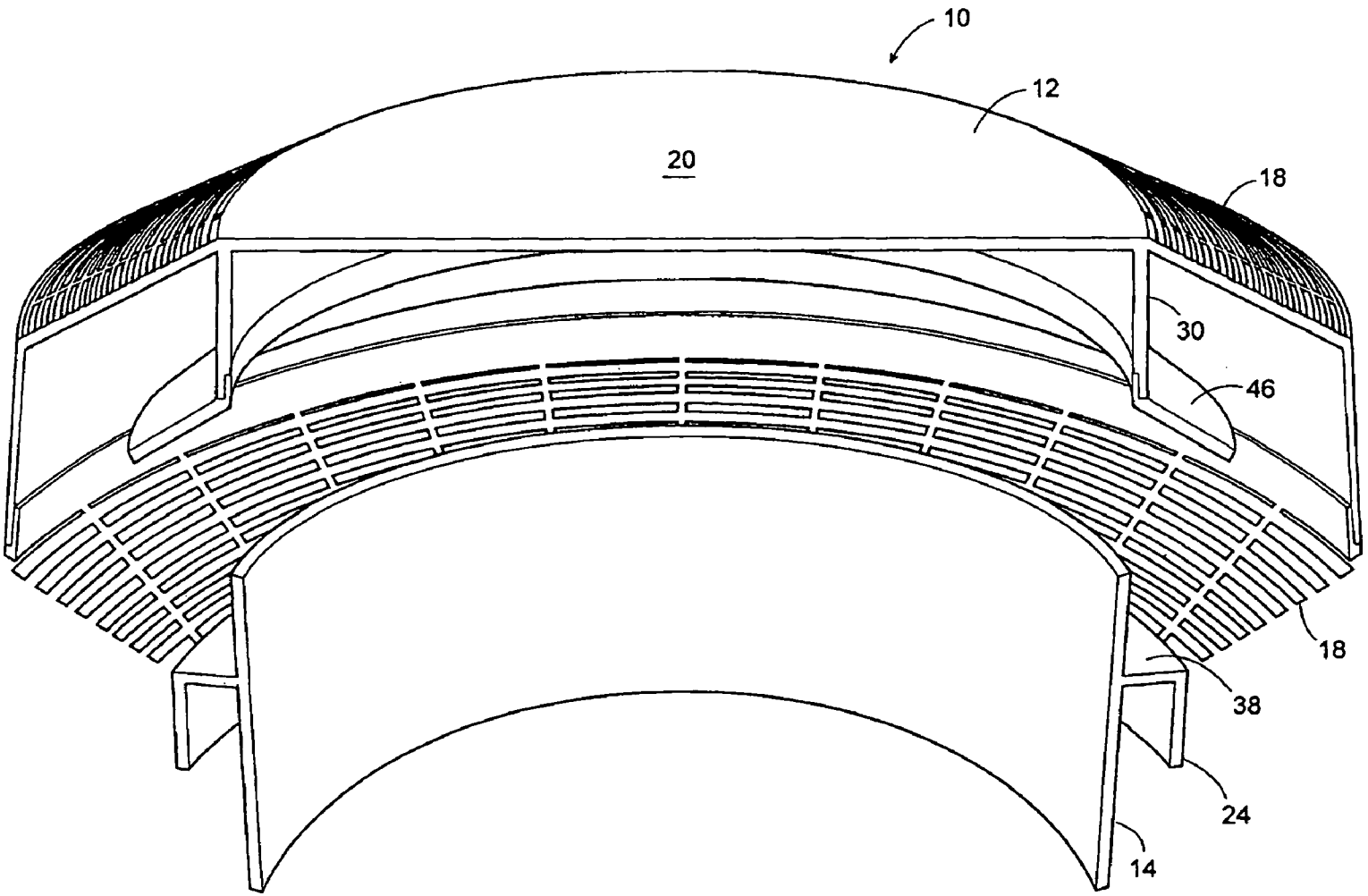
FIG. 7 is a cross-sectional view of another embodiment of the roof vent of FIG. 1, showing the feature of a skirt attached to the top baffle.

FIG. 7 shows a cross-sectional view of another embodiment of the roof vent 10. In this view there is shown a further feature of a skirt 46 that is attachable to the top cylindrical baffle 30, by a friction fit coupling or the like, to help direct snow and moisture entering through the top louvered region away from the exhaust stack 25, on to the channel 38, and out of the roof vent 10.

As will be appreciated by those skilled in the art, the present invention can be used to replace or instead of turbine vent devices which are commonly installed to either a twelve inch or fourteen inch diameter exhaust stack 25. The combination of a louvered vent region 18 that expands outwardly from the exhaust stack 25, and an internal baffle system, maximizes air flow from a twelve inch or fourteen inch diameter hole to an area in excess of 120 inches, while at the same time helping to limit the amount of weather and insects that enters through the roof vent 10 into the exhaust stack 25.

Figure 8:
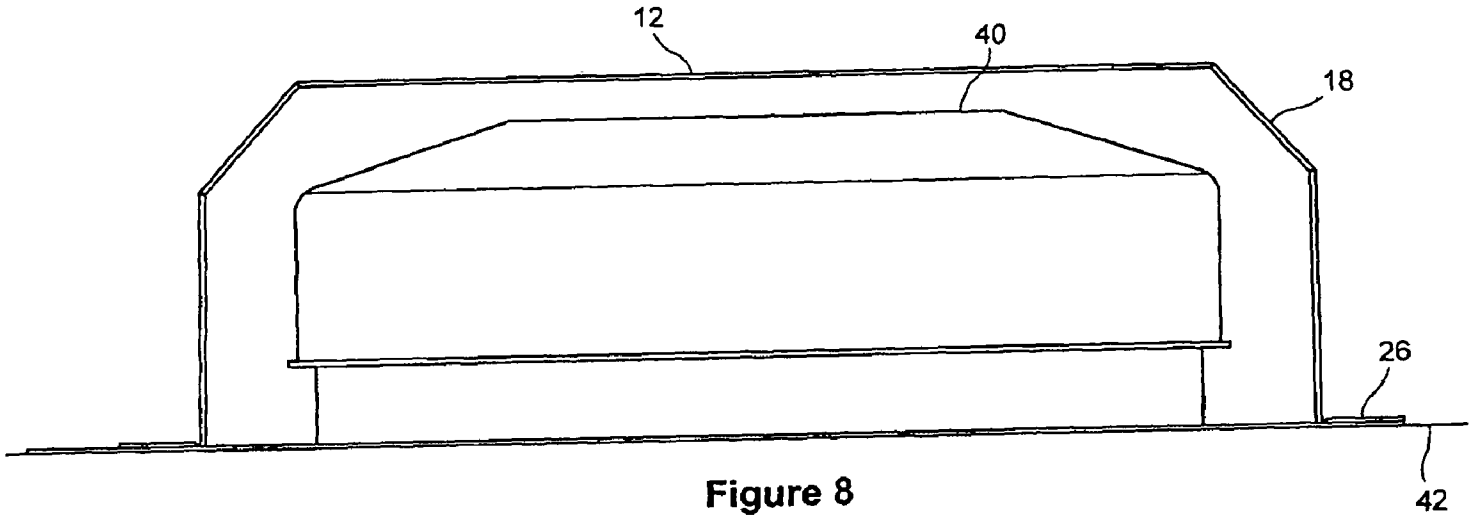
FIG. 8 is a cross-sectional view of the top component of FIG. 3, installed on a roof over top of a passive pot vent.

According to a further aspect of the present invention, the top component 12 (shown in FIG. 4) is sized and shaped so it may be used separately as a shelter to cover over existing passive pot vents that may be leaking or unsightly. As shown in FIG. 8 the top component 12 may be installed over a passive pot vent 40 on a roof 42. The top component 12 is secured to the roof 42 via tabs 26 located at the lower edge 13 of the top component 12. The tabs 26 are attached to the top component 12 via living hinges 44, as shown in FIG. 9, to allow the tab 26 to adjust to the roof surface 42. The living hinges 44 of the tabs 26 also allow the top component 12 to be packaged in a smaller box by folding the tabs down to take up less space. It can now be understood that the diameter of the top baffle must be large enough to accommodate a pot vent within the diameter. Thus, this is another reason it is preferred to make the top baffle outside of the bottom baffle as explained above and as shown in the drawings.

When installed, as shown in FIG. 8, the top component 12 allows air to be exhausted through the louvered region 18, while allowing fresh air to replace the exhausted stale air. As described above the baffles create a sinuous or tortuous path for precipitation and snow, in order to help inhibit moisture from entering into the exhaust stack 25. Furthermore, by completely covering the passive pot vent 40 it can turn an aging installation into an aesthetically pleasing one. Any precipitation that does make it past the louvered region 18 will first strike the top baffle and if it can get past the top baffle will likely encounter to top of the covered up pot vent. It is unlikely that any moisture will get past both the vent cover and the old vent, and the water that is stopped and collected is caused to drain outside through a plurality of water drains 28 which are disposed along the lower edge 13 of the top component 12, as shown in FIG. 3. It should be noted that these water drains 28 are covered by the lip 15 on the bottom component 14 when the top component 12 and bottom component 14 are coupled together to form the roof vent 10 as described above with respect to the first aspect of the present invention.

When the top component 12 is used to shelter a passive pot vent 40, as described above, the top cylindrical baffle 30 of the baffle system may be removed or left in place. It is believed to be preferred to leave it in place, again to help prevent moisture from penetrating through the vent. The top cylindrical baffle 30 is therefore sized and shaped so that when the top component 12 is placed on a planar surface, a gap exists between the lower edge of the top cylindrical baffle 30 and the top of the planar surface. In comparison, since the bottom component 14 does not have to match a planar surface and in light of the desired to create, between the two baffles, a sinuous path the bottom cylindrical baffle 32 the present invention comprehends that the lower louver may extend above the height of the top outer edge of the lower portion. In this way the edge 36 of the bottom cylindrical baffle 32 is can above the edge 34 of the top cylindrical baffle 30 in the assembled position, but only if it is spaced inwardly enough to provide a free air flow path. Thus, the most preferred form of the invention as shown in the drawings has the lower baffle spaced slightly inwardly of the upper baffle, and there being no vertical overlap between the two. The angle of slats of the louvers is used to direct the air flow, and thus precipitation, away from the opening between the upper and lower baffles. Also, the removable collar assists in this regard. As will be understood by those skilled in the art, the degree of vertical overlap between the baffles can be varied, and it is not be necessary to have any vertical overlap due to the horizontal spacing between the baffles. What is desired is to have a baffle structure which broadly inhibits the inflow of moisture into the vent, and corresponding structures in the body of the vent to control and drain away any such moisture so inhibited.

As can be appreciated from the above description, the top component 12 may be used separately from the bottom component 14 as a shelter to cover aging passive pot vents to stop snow and rain from entering and for providing an aesthetics to the vent 40. According to the present invention this improved performance can be achieved without the need to remove the old vent, thus saving time and effort and expense. In one simple step the old leaky vent can be covered and the combination of the old vent and the cover can be much more successful at inhibiting moisture inflow than was the old vent before. A further advantage is that it prevents staining on the roof by changing exhaust air to a chimneys effect.

While reference has been made to various preferred embodiments of the invention other variations are comprehended by the broad scope of the appended claims. Some of these have been discussed in detail in this specification and others will be apparent to those skilled in the art. All such variations and alterations are comprehended by this specification are intended to be covered, without limitation.

The embodiments of the invention in which an exclusive property or privilege is claimed are defined as follows:

1. A passive roof vent comprising:

a top component having a top wall, a side wall, a first louvered region disposed between said top wall and said side wall, and a top cylindrical baffle attached to said top wall inwardly of said first louvered region; and a bottom component coupled to said top component, said bottom component having at least a first cylindrical collar sized and shaped for mounting to a cylindrical exhaust stack of a first diameter, a second louvered region, a bottom cylindrical baffle attached to said bottom component inwardly of said second louvered region and being sized and positioned relative to said top baffle to pass water entering said vent through said first louvered region out of said vent through said second louvered region and to permit air to pass between said top cylindrical baffle and said bottom cylindrical baffle through said vent.

2. A roof vent as claimed in claim 1, wherein said top component and said bottom component are coupled by a friction fit coupling.

3. A roof vent as claimed in claim 2, wherein said top component has a lower edge, and said bottom component has a complementary lip, and said friction fit coupling is effected by engaging said lower edge with said complementary lip.

4. A roof vent as claimed in claim 1, further comprising a second cylindrical collar sized and shaped for mounting to a cylindrical exhaust stack of a second diameter.

5. A roof vent as claimed in claim 1, wherein said first louvered region and said second louvered region are positioned outwardly from said exhaust stack.

6. A roof vent as claimed in claim 5, wherein said outward positioning of said louvered regions increases a net free air flow area from a twelve inch diameter exhaust stack in excess of 120 inches.

7. A roof vent as claimed in claim 1, wherein said first louvered region and said second louvered region, in combination with said top cylindrical baffle and said second cylindrical baffle create a tortuous path to help inhibit moisture, such as snow and rain from entering said exhaust stack while allowing exhaust air to pass through to outside of said roof vent.

8. A roof vent as claimed in claim 1, wherein said bottom component further comprises a channel abutting a base of said bottom cylindrical baffle, said channel being for directing water out of said roof vent.

9. A roof vent as claimed in claim 1, wherein said top component further comprises a plurality of tabs joined to a lower edge of said side wall.

10. A roof vent as claimed in claim 9, wherein said tabs can be used to secure said coupling of said top component to said bottom component.

11. A roof vent as claimed in claim 1, further comprising a skirt attached to said top baffle, said skirt expanding outwardly from said top baffle, said skirt being for helping to direct moisture, such as snow and rain, entering from said roof vent through said first louvered region, away from said exhaust stack.

12. A roof vent as claimed in claim 1, wherein said top component may be used separately to cover over an existing passive pot vent.

13. A roof vent as claimed in claim 12, wherein said top component further comprises a plurality of water drains disposed along a lower edge of said side wall.

14. A roof vent as claimed in claim 12, wherein said top component further comprises a plurality of tabs joined to said lower edge of said side wall.

15. A roof vent as claimed in claim 14, wherein said tabs can be used to secure said coupling of said top component to a roof.

16. A passive roof vent system comprising:

a bottom component mounted to an exhaust stack, said bottom component comprising a lower outer surface with a plurality of air ventilation openings therein, a lower interior baffle attached to said lower surface inwardly of said plurality of air ventilation openings, and a bottom collar that receives said exhaust stack;

a top component sized and shaped to be mounted to said bottom component, said top component comprising an upper inner surface, an upper outer surface attached to and about said upper inner surface, and an upper interior baffle attached to said upper inner surface, wherein said upper and lower interior baffles cooperate with said plurality of air ventilation openings to provide weather and insect protection while allowing air exhaust.

17. A roof vent system according to claim 16, wherein said upper interior baffle surrounds at least a portion of said lower interior baffle and a spaced apart air gap exists between said upper interior baffle and said lower interior baffle with said top component mounted to said bottom component.

18. A roof vent system according to claim 17, wherein said upper interior baffle in combination with said lower interior baffle provide a tortuous air flow passageway.

19. A roof vent system according to claim 16, wherein said top component includes said upper outer surface with another plurality of air ventilation openings and said upper interior baffle is located inwardly of said another plurality of air ventilation openings.

20. A passive roof vent installation provided by the installation steps comprising:

mounting a bottom component to an exhaust stack, said bottom component comprising a lower outer surface with a first plurality of air ventilation openings, a lower interior baffle attached to said bottom component inwardly of said first plurality of air ventilation openings therein to prevent water from passing through said first plurality of air ventilation openings into said vent, and a bottom collar receiving said exhaust stack;

mounting a top component onto said bottom component, said top component comprising an upper inner surface, an upper outer surface attached to and about said upper inner surface, said upper outer surface having a second plurality of air ventilation openings therein, and an upper interior baffle attached to said upper inner surface to prevent water from passing through said second plurality of air ventilation openings into said vent, wherein said upper and lower interior baffles cooperate with said first and second ventilation openings to provide weather and insect protection while allowing air exhaust.

21. A roof vent as claimed in claim 5, wherein said outward positioning of said louvered regions increases a net free air flow area from a fourteen inch diameter exhaust stack in excess of 120 inches.

22. A passive roof vent system comprising:

a bottom component mounted to an exhaust stack, said bottom component comprising a lower outer surface with a plurality of air ventilation openings therein, a lower interior baffle attached to said bottom component inwardly of said lower outer surface, and a bottom collar that receives said exhaust stack;

a top component sized and shaped to be mounted to said bottom component, said top component comprising an upper inner surface, an upper outer surface attached to and about said upper inner surface, said upper outer surface having a plurality of air ventilation openings therein, and an upper interior baffle attached to said upper inner surface, wherein said upper and lower interior baffles cooperate with said ventilation openings to provide weather and insect protection while allowing air exhaust.

23. The passive roof vent system of claim 22 wherein said bottom collar includes a top opening and a bottom opening and a tapered portion therebetween, said top opening is smaller in diameter than said bottom opening.

24. The roof vent system according to claim 1, wherein said first louvered region is a plurality of air ventilation openings.

25. The roof vent system according to claim 24, wherein said first louvered region includes ribs, said ribs support said plurality of air ventilation openings.

26. A roof vent as claimed in claim 1, wherein said top cylindrical baffle has a larger diameter than said second cylindrical baffle, said first louvered region and said second louvered region, in combination with said top cylindrical baffle and said second cylindrical baffle create a tortuous path to help inhibit moisture, such as snow and rain from entering said exhaust stack while allowing exhaust air to pass through to outside of said roof vent.

27. A roof vent as claimed in claim 1, further comprising a skirt attached to said top baffle by a friction fit coupling, said skirt expanding outwardly from said top baffle, said skirt being for helping to direct moisture, such as snow and rain, entering from said roof vent through said first louvered region, away from said exhaust stack.

28. A roof vent as claimed in claim 14, further including hinges, said hinges attach said tabs to said top component, wherein said tabs can be used to secure said coupling of said top component to a roof.

29. A roof vent system according to claim 17, wherein said upper interior baffle has a larger diameter than said lower interior baffle, and said upper interior baffle in combination with said lower interior baffle provide a tortuous air flow passageway.

* * * * *

UNITED STATES PATENT AND TRADEMARK OFFICE

CERTIFICATE OF CORRECTION

PATENT NO. : 7,774,999 B2
APPLICATION NO. : 11/705619
DATED : August 17, 2010
INVENTOR(S) : McKee et al.

It is certified that error appears in the above-identified patent and that said Letters Patent is hereby corrected as shown below:

On the Title page, the printed patent incorrectly reads, "(75) Inventor – James H.A. McKee, Midhurst (CA)"; the patent should read -- (75) Inventors – James H.A. McKee, Midhurst (CA); James Mantyla, Barrie, Ontario (CA) --.

On the Title page, the printed patent incorrectly reads "(57) ABSTRACT – A roof vent is provide."; the patent should read instead as -- (57) ABSTRACT – A roof vent is provided. --.

In the Specifications:
At column 6, line 6, the printed patent reads "...baffle 32 is can above the edge..."; the patent should read instead as -- ...baffle 32 is above the edge... --.

Signed and Sealed this

Nineteenth Day of October, 2010

David J. Kappos

David J. Kappos
*Director of the United States Patent and Trademark Office*